US008579475B2

(12) United States Patent
Tsai

(10) Patent No.: US 8,579,475 B2
(45) Date of Patent: Nov. 12, 2013

(54) ARTISTIC FORMATIVE LAMPSHADE ASSEMBLY

(76) Inventor: Chien-Tsai Tsai, New Taipei (TW)

( * ) Notice: Subject to any disclaimer, the term of this patent is extended or adjusted under 35 U.S.C. 154(b) by 168 days.

(21) Appl. No.: 13/302,162

(22) Filed: Nov. 22, 2011

(65) Prior Publication Data

US 2013/0128595 A1 May 23, 2013

(51) Int. Cl.
*F21V 1/06* (2006.01)

(52) U.S. Cl.
USPC ..... 362/352; 362/361; 362/410; 362/413; 362/355

(58) Field of Classification Search
USPC ..... 362/352, 351, 355, 359, 361, 410, 413; 248/529
See application file for complete search history.

(56) References Cited

U.S. PATENT DOCUMENTS 4,075,472 A * 2/1978 Higuchi ..... 362/255
4,075,684 A * 2/1978 Witz ..... 362/352
4,086,738 A * 5/1978 Saccoccio ..... 52/270
4,120,027 A * 10/1978 Stark ..... 362/352
4,146,918 A * 3/1979 Tureck ..... 362/16
4,165,529 A * 8/1979 Hagelthorn ..... 362/352
4,167,034 A * 9/1979 Noguchi ..... 362/414

* cited by examiner

*Primary Examiner* — Ali Alavi
(74) *Attorney, Agent, or Firm* — Rosenberg, Klein & Lee

(57) ABSTRACT

An artistic formative lampshade assembly comprises a longitudinal support body, a fabric cover, and a transverse support body, wherein the longitudinal support is a flat body or a rod and the transverse support body formed into a circular or rectangular shape by a butt joint structure. Further, the fabric cover is made of a transparent, flexible, soft fabric. The transverse body set into the fabric cover hitches the buckles on the fabric cover and the hooks on the both ends of the longitudinal support so that the longitudinal support body is encircled by the transverse support body to form a cubical space. Therefore, the light bulb in the center of the fabric cover can keep a safety distance from the upper covering body and lower covering body. The present invention is easy to pack and transport, and enables the light illuminates evenly for both practical use and ornamental art.

8 Claims, 10 Drawing Sheets

ARTISTIC FORMATIVE LAMPSHADE ASSEMBLY

BACKGROUND OF THE INVENTION

1. Field of the Invention

The present invention relates to a lampshade assembly and more particularly, to an artistic formative lampshade assembly, which provides a convenient and easy way to pack, transport, and assemble.

2. Description of the Related Art

Lamp is a requisite device commonly used in our daily life. According to the design of different lampshades, the lamps have different functions in various places. For example, some lamps are designed for illuminating, and some are for decorations. Therefore, people focus more on the design of the lampshades.

Lampshade is a hollow component so it is not conducive to store, pack, and transport. Therefore, people developed different kinds of foldable lampshade assemblies. However, most traditional lampshade assemblies are disassembled into many units for transporting and assembled after arrival. The aforesaid feature is disclosed in U.S. Pat. Nos. 6,773,145, 6,439,746, 6,837,597, 7,473,015, 5,287,259, 5,613,770, 6,206,551, 4,688,155, and 2004/0125604. Some lampshades made of fragile materials do not have strong structures, and some lampshades only have illustrating function. Besides, most DIY lampshades need hand tools while assembling. Therefore, there is room for improvement.

SUMMARY OF THE INVENTION

It is a primary object of the present invention to provide an artistic formative lampshade assembly, which is a flat body before assembling so it is easy to pack and transport and enables the user to assemble the lampshade conveniently with less effort without tools.

The second object of the present invention to provide an artistic formative lampshade assembly, which enables the light bulb to keep a safety distance from the fabric cover after assembling so that the light illuminates evenly for both practical use and ornamental art.

The third object of the present invention to provide an artistic formative lampshade assembly, which can be disassembled and washed for keeping it bright and clean.

In order to achieve the above-mentioned objects, the invention includes a longitudinal support body, a fabric cover made of a transparent, flexible soft fabric, and a transverse support body.

The longitudinal support body includes a set of symmetrical arch-shaped bracket having an upper connector and a lower connector on both upper and lower ends thereof. Multiple hooks are arranged on the outer side of the upper connector and the lower connector, and a bulb mounted base connected to the center of the longitudinal support body.

A largest external periphery of the transverse support body forms a circular or rectangular enlarged part. Along the periphery of the enlarged part, the fabric cover is divided into an upper covering body and a lower covering body respectively having at least two cutting seams from the center of the fabric cover to the enlarged part in order to form at least two pieces of liftable cover surfaces. Multiple buckles on the inner side of the cover surfaces are provided for buckling up the hooks.

The transverse support body is set to be a circular or rectangular frame body according to the shape of the enlarged part. The frame body is composed of two symmetrical frame strips having a butt joint structure on both ends for connecting to each other. The transverse support body are mounted on the inner margin of the enlarged part to prop up the enlarged part and generate a tension force by hooking up the buckles of the upper and lower cover surfaces and the hooks of the upper and lower connectors so that the longitudinal support body is encircled by the transverse support body to form a cubical space, and at least a light bulb is installed in the bulb mounted base which is in the center of the fabric cover for keeping a safety distance from the upper and lower covering bodies.

Further, the two arch-shaped brackets form a symmetrical frame body with the narrow ends and a wide body, and a longitudinal through-hole is provided for a power cord of the bulb mounted base.

Furthermore, the transverse support body can be a circular frame body composed of two symmetrical semi-circular frame strips, and one end of the butt joint structure is a sleeve and another end thereof is an inserted column for butting and jointing each other. The transverse support body can also be a rectangular frame body composed of two symmetrical U-shaped frame strips, and one end of the butt joint structure is a sleeve and another end thereof is an inserted column for butting and jointing each other.

In another preferred embodiment of the present invention, the longitudinal support body includes a vertical rod having an upper connector and a lower connector on both upper and lower ends thereof. Multiple hooks are arranged on the outer side of the upper connector and the lower connector, and a bulb mounted base connected to the center of the longitudinal support body.

Based on the technical features disclosed, the artistic formative lampshade assembly enables the user to assemble the lampshade conveniently with less effort without tools.

DETAILED DESCRIPTION OF THE PREFERRED EMBODIMENT

Referring to FIGS. 1 through 5, the first preferred embodiment of the invention comprises a longitudinal support body 10, a fabric cover 20 made of a transparent, flexible, soft fabric, and a transverse support body 30.

Figure 5:
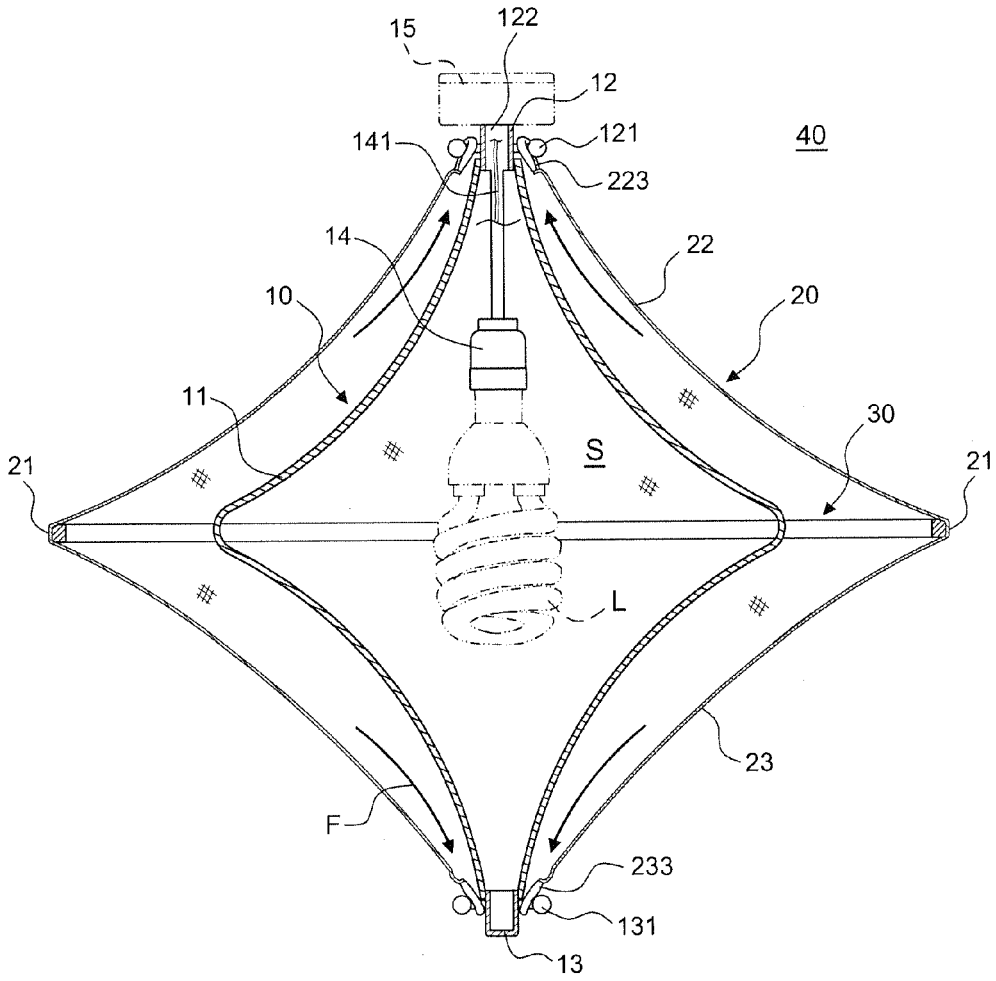
FIG. 5 is a sectional view of the first embodiment of the present invention.

The longitudinal support body 10 includes a set of symmetrical arch-shaped bracket 11 having an upper connector 12 and a lower connector 13 on both upper and lower ends thereof. Multiple hooks 121, 131 are arranged on the outer side of the upper connector 12 and the lower connector 13. A bulb mounted base 14 is connected to the center of the longitudinal support body 10. In this embodiment as shown in FIG. 5, the two arch-shaped brackets 11 forms a symmetrical frame body with the narrow ends and a wide body, and a longitudinal through-hole 122 is provided for a power cord 141 of the bulb mounted base 14.

A largest external periphery of the longitudinal support body 10 forms a circular or rectangular enlarged part 21. Along the periphery of the enlarged part 21, the fabric cover 20 is divided into an upper covering body 22 and a lower covering body 23 respectively having at least two cutting seams 221, 231 from the center of the fabric cover 20 to the enlarged part 21 in order to form at least two pieces of liftable cover surfaces 222, 232. Multiple buckles 223, 233 on the inner side of the cover surfaces 222, 232 are provided for buckling up the hooks 121, 131.

The transverse support body 30 is set to be a circular or rectangular frame body according to the shape of the enlarged part 21; the frame body is composed of two symmetrical frame strips 31, 32 having a butt joint structure 33 on both ends for connecting to each other. The transverse support body 30 is mounted on the inner margin of the enlarged part 21 to prop up the enlarged part 21 and generate a tension force F by hooking up the buckles 223, 233 of the upper and lower cover surfaces 222, 232 and the hooks 121, 131 of the upper and lower connectors 12, 13 so that the transverse support body 30 encircles the longitudinal support body 10 to form a cubical space, and at least a light bulb L is installed in the bulb mounted base 14 in the center of the fabric cover 20 for keeping a safety distance from the upper and lower covering bodies 22, 23.

Figures 1, 1A:
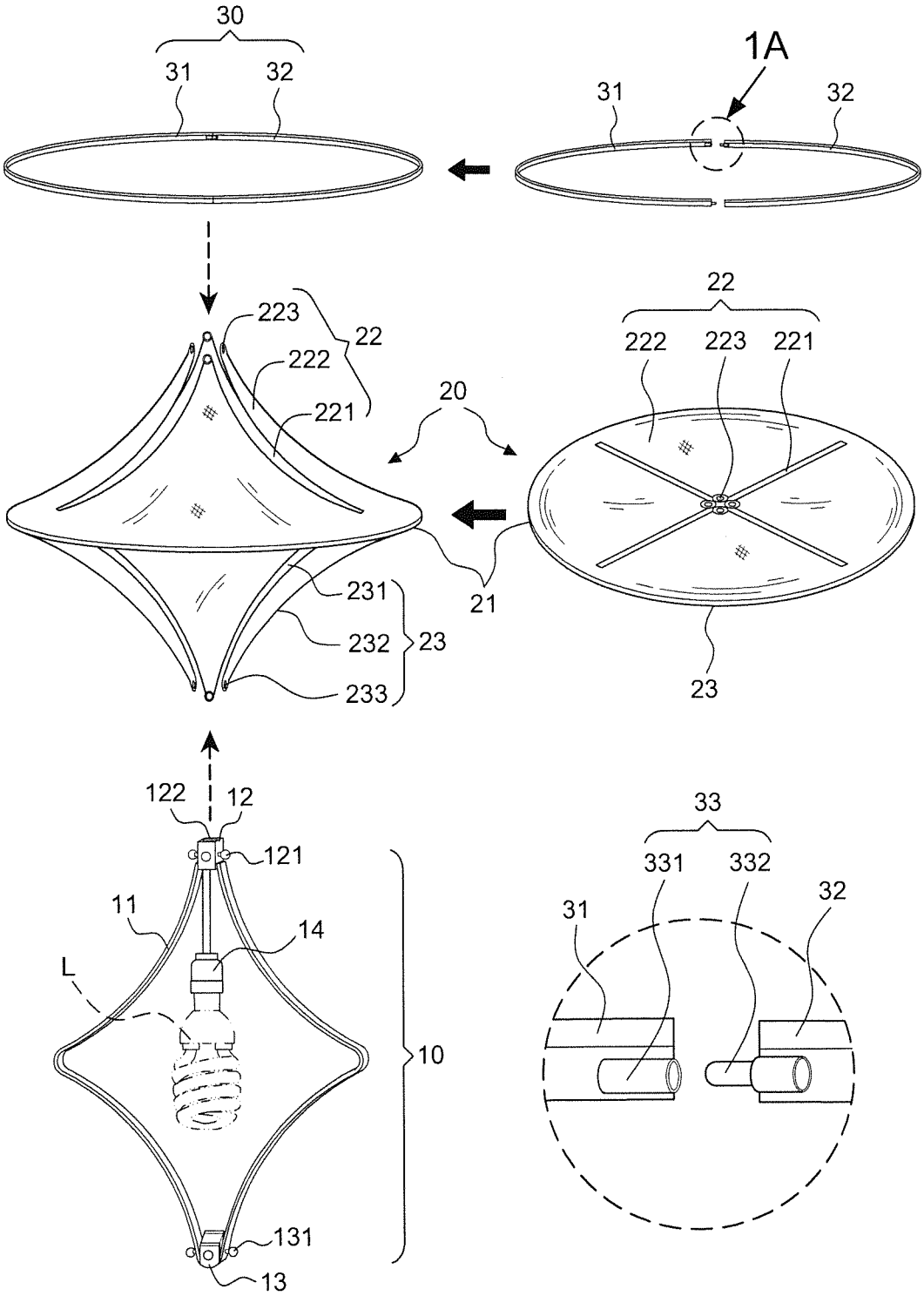
FIG. 1 is an exploded perspective view of the first embodiment of the present invention illustrating the lampshade in a circular shape.
FIG. 1A is an enlarged schematic view of 1A in FIG. 1.
Figure 2A:
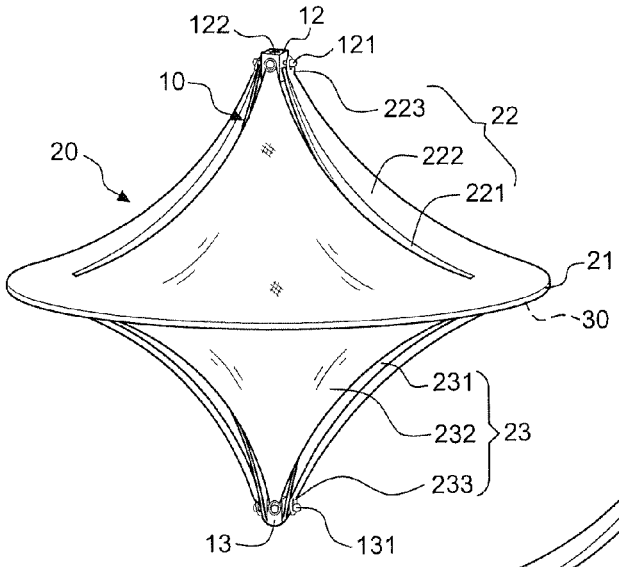
FIG. 2A is a perspective view illustrating the assembly of FIG. 1.
Figure 2B:
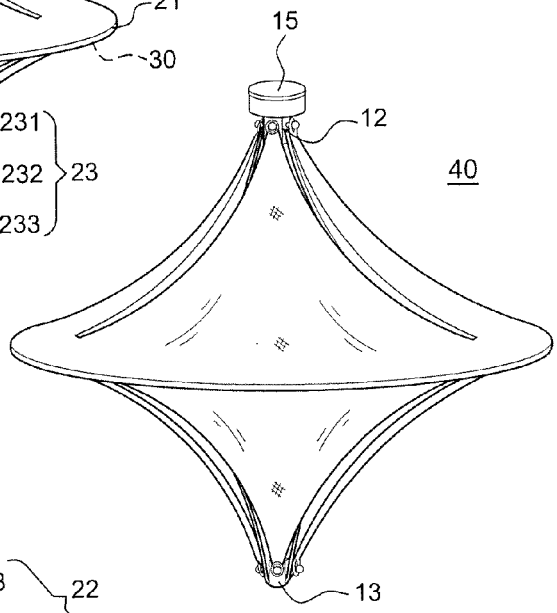
FIG. 2B is a perspective view illustrating FIG. 2A with a lid body.
Figure 2C:
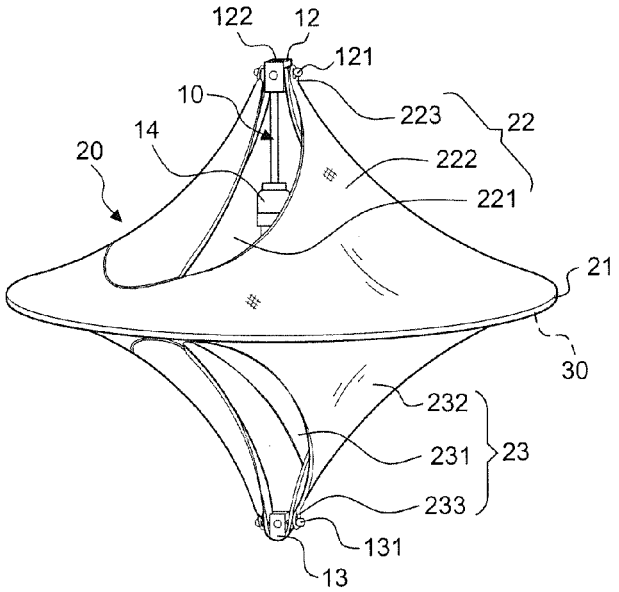
FIG. 2C is a perspective view illustrating another fabric cover.
Figures 3, 3A:
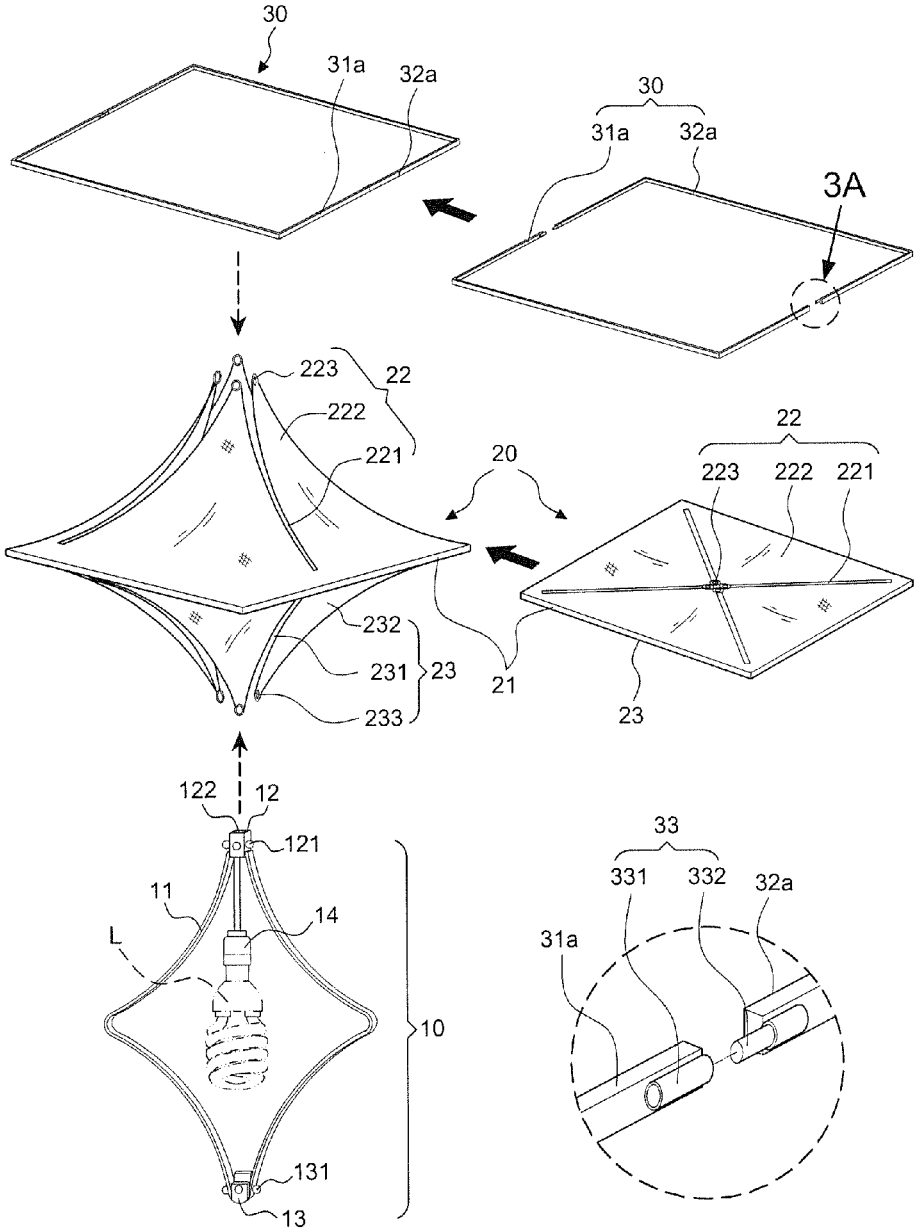
FIG. 3 is an exploded perspective view of the first embodiment of the present invention illustrating the lampshade in a rectangular shape.
FIG. 3A is an enlarged schematic view of 3A in FIG. 3.

In this embodiment as shown in FIGS. 1 to 2C, the transverse support body 30 is a circular frame body composed of two symmetrical semi-circular frame strips 31, 32, and one end of the butt joint structure 33 is a sleeve 331 and another end thereof is an inserted column 332 for butting and jointing each other. Further, with reference to FIGS. 3 through 4C, the transverse support body 30 is a rectangular frame body composed of two symmetrical U-shaped frame strips 31*a*, 32*a*, and one end of the butt joint structure 33 is the sleeve 331 and another end thereof is the inserted column 332 for butting and jointing each other.

With reference to FIGS. 1 and 2A, the fabric cover 20 is in a circular shape, and there are four cutting seams 221, 231 respectively forming four symmetrical cover surfaces 222, 232. This present preferred embodiment is simply an example but not a limitation. The cutting seams 221, 231 as shown in FIG. 2C are not four seams but two cutting seams (holes) 221, 231 for the longitudinal support body 10 and the transverse support body 30 to insert into the fabric cover 20 smoothly and prop up the enlarged part 21.

Figure 4A:
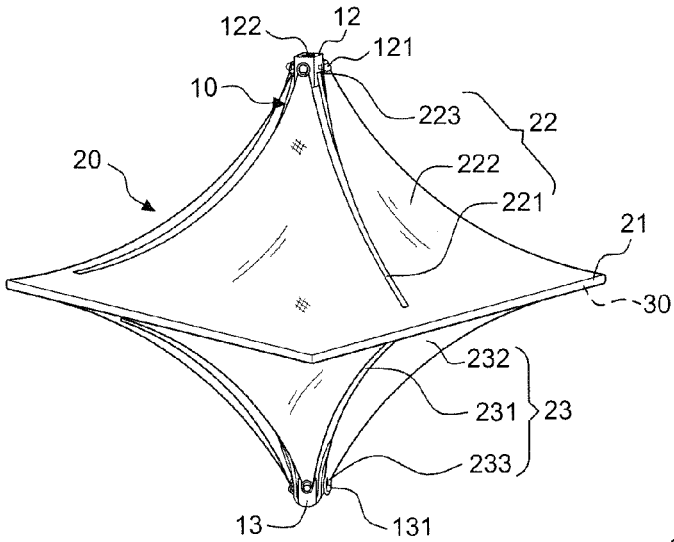
FIG. 4A is a perspective view illustrating the assembly of FIG. 3.
Figure 4B:
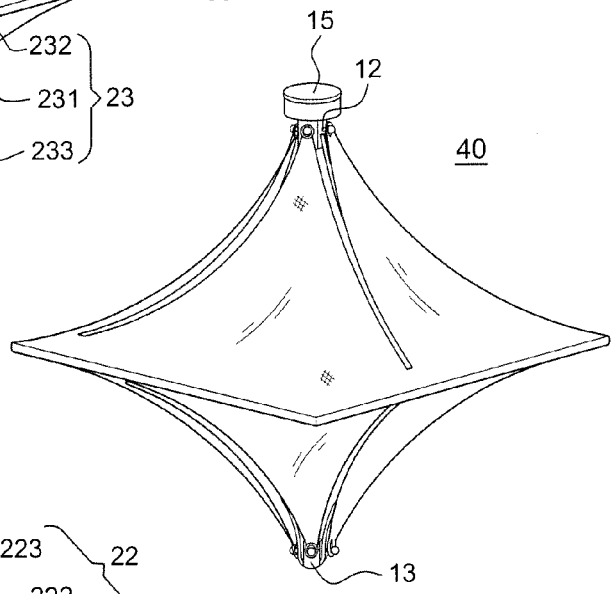
FIG. 4B is a perspective view illustrating FIG. 4A with a lid body.
Figure 4C:
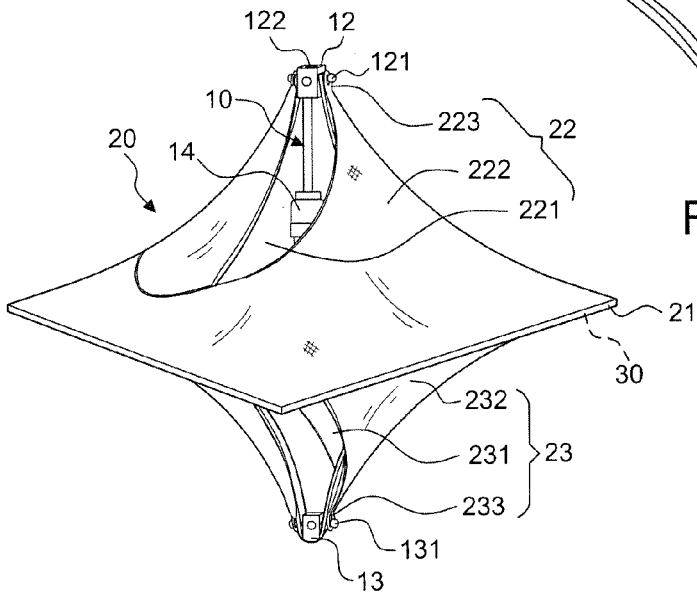
FIG. 4C is a perspective view illustrating another fabric cover.

The fabric cover 20 as shown in FIGS. 3, 4A, 4B, and 4C is in a rectangular shape and structure thereof is as same as the aforesaid circular lampshade. Further, the upper connector 12 includes a lid body 15 as shown in FIGS. 2B and 4B for connecting and fixing the other components with the formative lampshade 40.

FIG. 5 illustrates the main features of the present invention, which makes the longitudinal support body 10 as the backbone and the transverse support body 30 as the support for propping up the fabric cover 20 and forming a space S to install the light bulb L. The transverse support body 30 is either in a circular or rectangular shape, it is clamped by the fabric cover 20 and the tension force F is generated by hooking up the buckles 223, 233 of the upper and lower cover surfaces 222, 232 and the hooks 121, 131 of the upper and lower connectors 12, 13. Therefore, the outlook of the present invention looks streamlining and smooth. Besides, the safety distance between the fabric cover 20 and the light bulb L makes the present invention safe and prolonged to use. Moreover, the light from the fabric cover 20 is soft for not only lighting but also adding indoor atmosphere.

Figure 6:
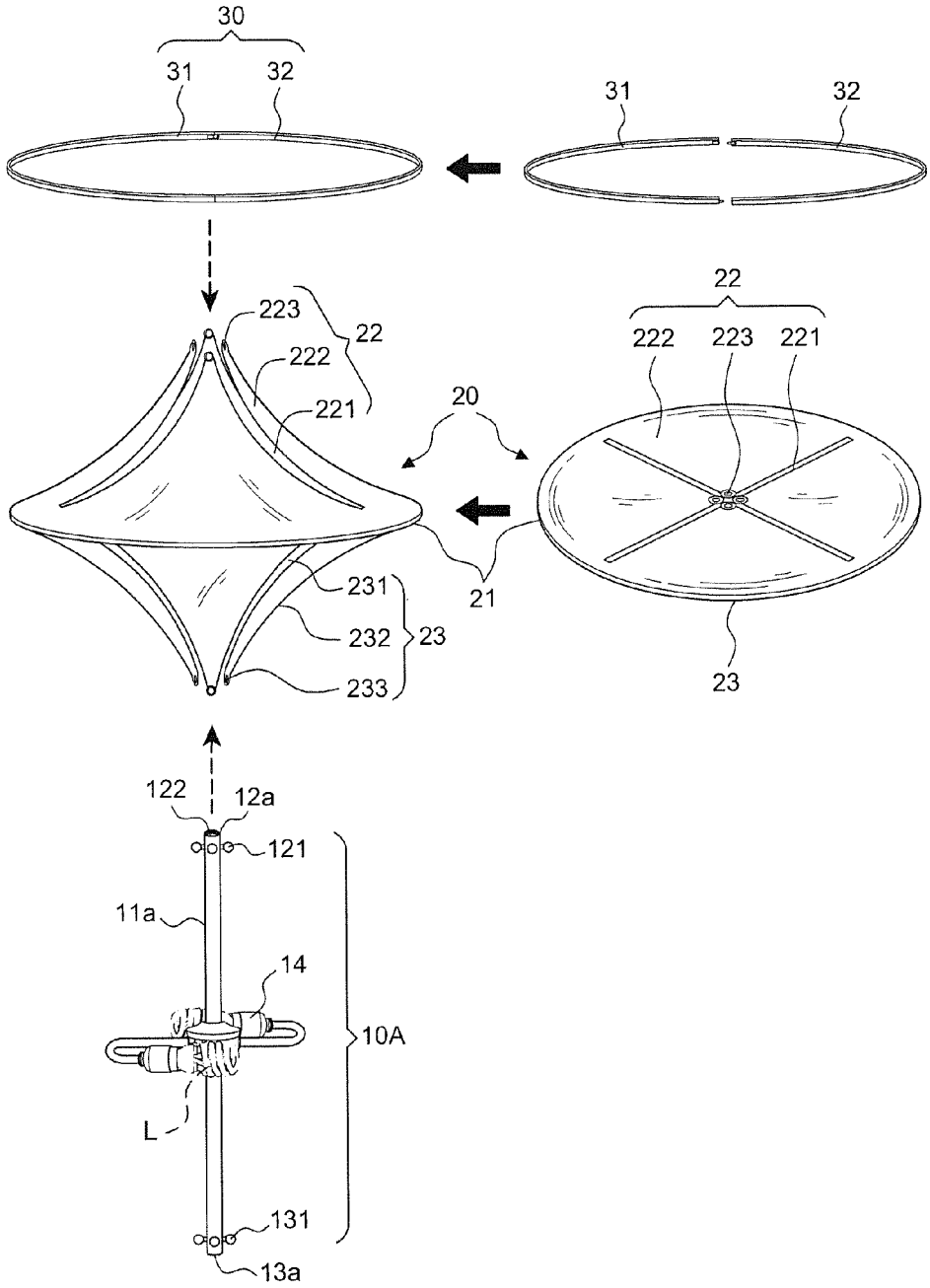
FIG. 6 is an exploded perspective view of the second embodiment of the present invention illustrating the lampshade in a circular shape.
Figure 7A:
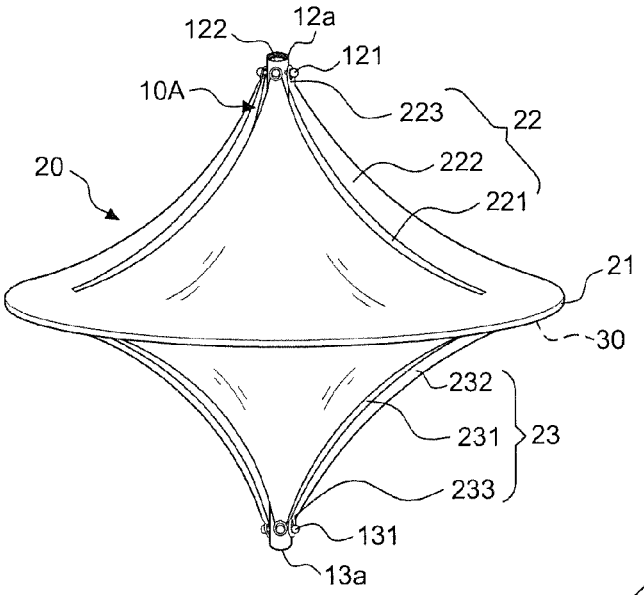
FIG. 7A is a perspective view illustrating the assembly of FIG. 6.
Figure 7B:
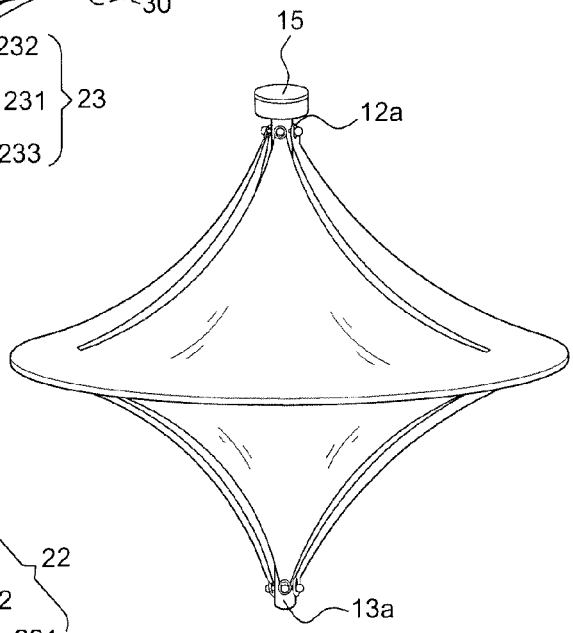
FIG. 7B is a perspective view illustrating FIG. 7A with a lid body.
Figure 7C:
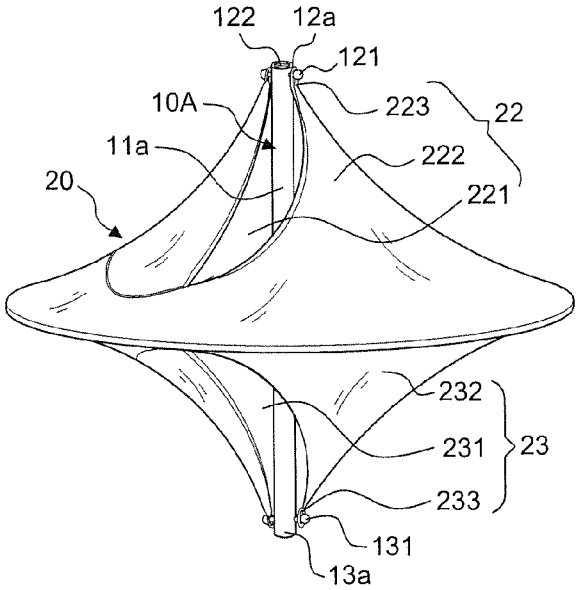
FIG. 7C is a perspective view illustrating another fabric cover.
Figure 8:
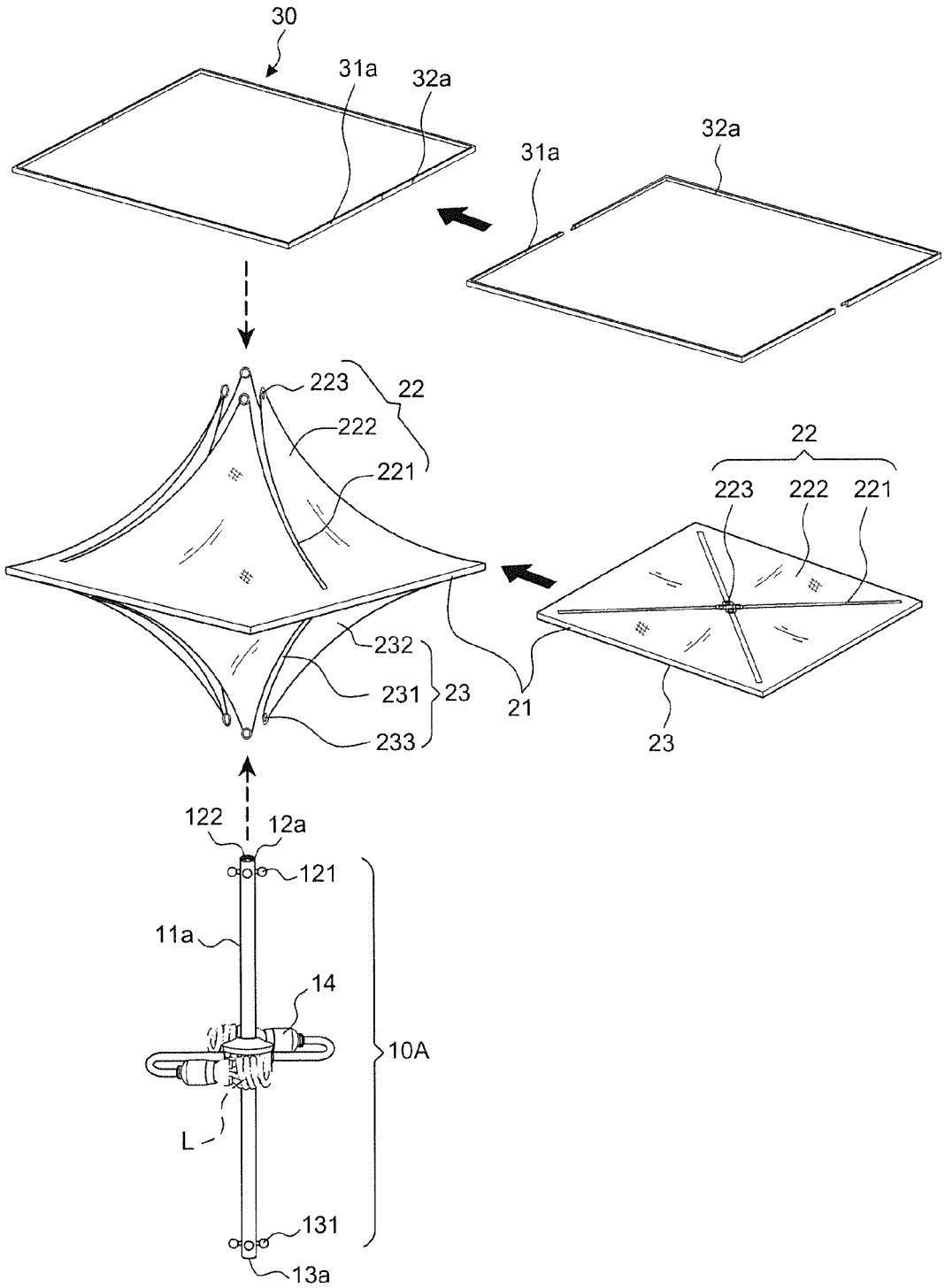
FIG. 8 is an exploded perspective view of the second embodiment of the present invention illustrating the lampshade in a rectangular shape.
Figure 9A:
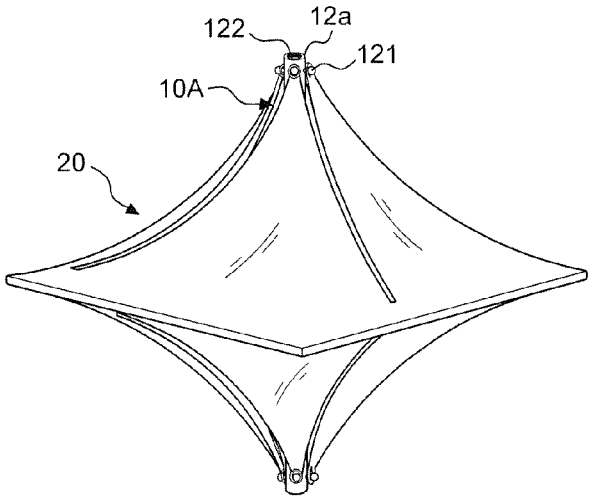
FIG. 9A is a perspective view illustrating the assembly of FIG. 8.
Figure 9B:
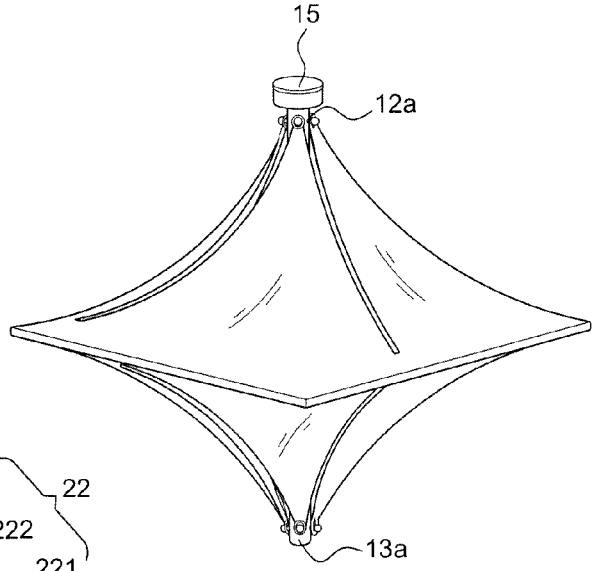
FIG. 9B is a perspective view illustrating FIG. 9A with a lid body.
Figure 9C:
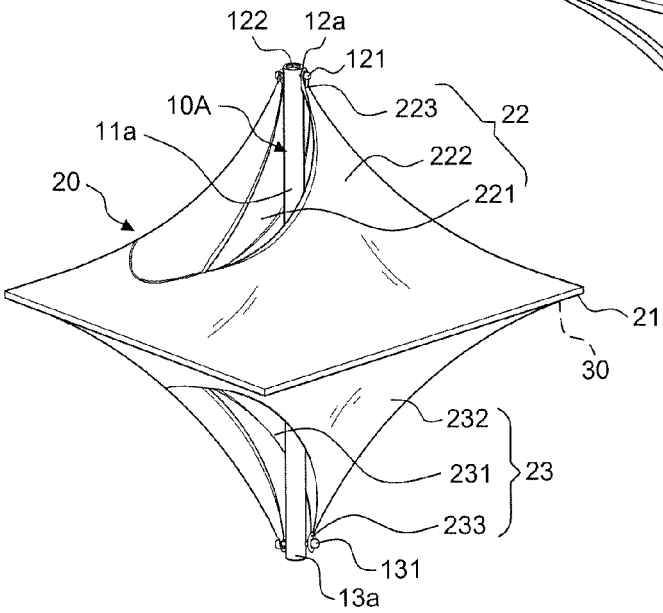
FIG. 9C is a perspective view illustrating another fabric cover.
Figure 10:
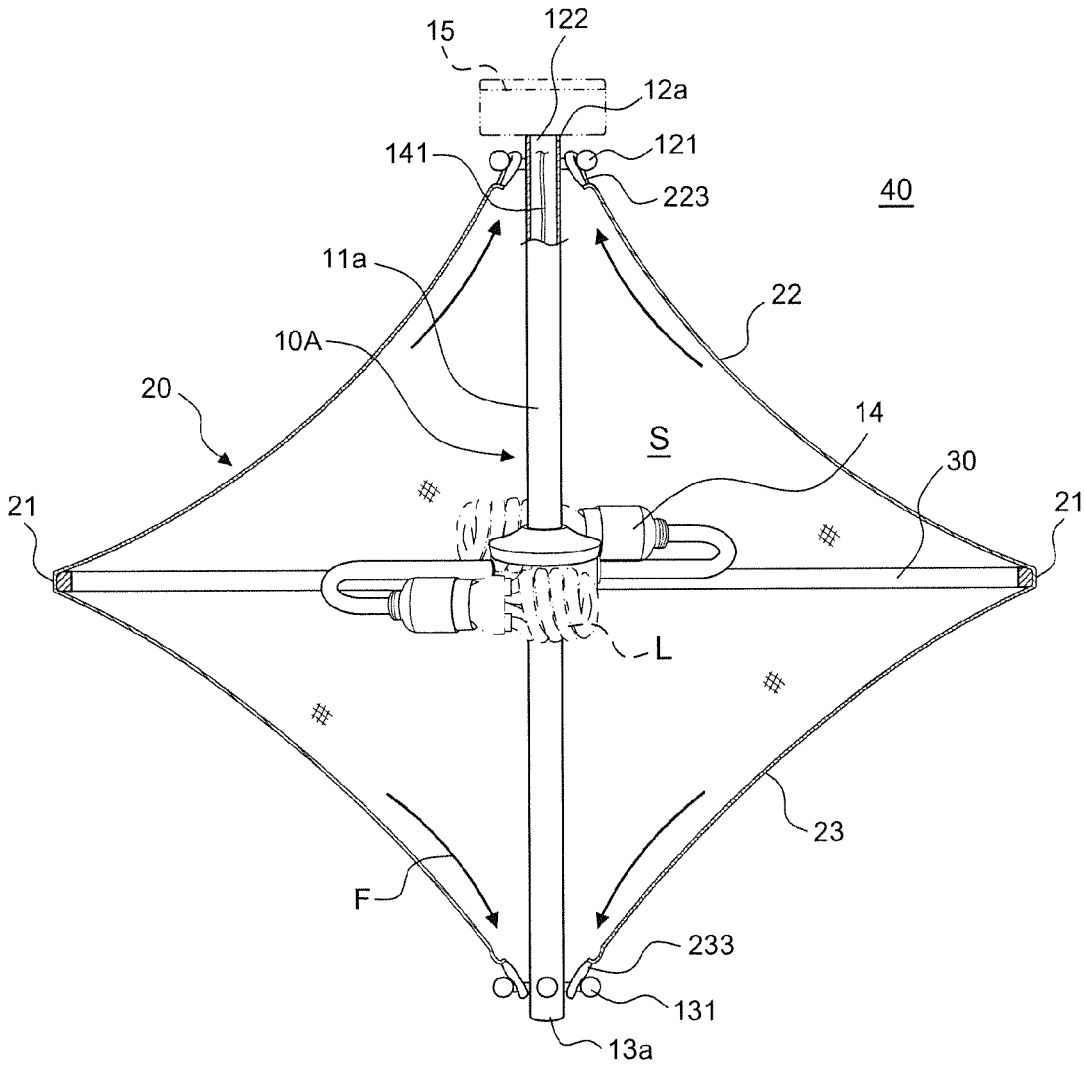
FIG. 10 is a sectional view of the second embodiment of the present invention.

Referring to FIGS. 6 through 10, the second preferred embodiment of the invention has the same structure as the first preferred embodiment but a longitudinal support body 10A which is composed of a vertical rod 11*a* having an upper connector 12*a* and a lower connector 13*a* on both upper and lower ends thereof. Multiple hooks 121, 131 are arranged on the outer side of the upper connector 12*a* and the lower connector 13*a* provided for the buckles 223, 233. At least a bulb mounted base 14 is connected to the center of the longitudinal support body 10A. In this embodiment as shown in FIGS. 6, 8 and 10, there are two bulb mounted bases 14 connected to the center of the longitudinal support body 10A. FIGS. 5 and 10 illustrate the same technical features of the formative lampshade 40.

Based on the technical features disclosed, the volume of the present invention before assembling is about one-fifth smaller than one after assembling. Therefore, it is easy to pack and transport. The user does not need any hand tools when assembling the artistic formative lampshade. Moreover, the artistic formative lampshade assembly can be disassembled and washed for keeping it bright and clean.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An artistic formative lampshade assembly, comprising:

a longitudinal support body including a set of symmetrical arch-shaped bracket having an upper connector and a lower connector on both upper and lower ends thereof, multiple hooks arranged on the outer side of the upper connector and the lower connector, a bulb mounted base connected to the center of the longitudinal support body;

a fabric cover made of a transparent, flexible, soft fabric, a largest external periphery thereof forming a circular or rectangular enlarged part, along the periphery of the enlarged part, the fabric cover is divided into an upper covering body and a lower covering body respectively having at least two cutting seams from the center of the fabric cover to the enlarged part in order to form at least two pieces of liftable cover surfaces, multiple buckles on the inner side of the cover surfaces provided for buckling up the hooks; and a transverse support body set to be a circular or rectangular frame body according to the shape of the enlarged part, the frame body composed of two symmetrical frame strips having a butt joint structure on both ends for connecting to each other, the transverse support body mounted on the inner margin of the enlarged part to prop up the enlarged part and generate a tension force by hooking up the buckles of the upper and lower cover surfaces and the hooks of the upper and lower connectors so that the transverse support body encircled the longitudinal support body to form a cubical space, and at least a light bulb installed in the bulb mounted base in the center of the fabric cover for keeping a safety distance from the upper and lower covering bodies.

2. The artistic formative lampshade assembly as claimed in claim 1, wherein the two arch-shaped brackets form a symmetrical frame body with the narrow ends and a wide body, and a longitudinal through-hole is provided for a power cord of the bulb mounted base.

3. The artistic formative lampshade assembly as claimed in claim 1, wherein the transverse support body is a circular frame body composed of two symmetrical semi-circular frame strips, and one end of the butt joint structure is a sleeve and another end thereof is an inserted column for butting and jointing each other.

4. The artistic formative lampshade assembly as claimed in claim 1, wherein the transverse support body is a rectangular frame body composed of two symmetrical U-shaped frame strips, and one end of the butt joint structure is a sleeve and another end thereof is an inserted column for butting and jointing each other.

5. An artistic formative lampshade assembly, comprising:

a longitudinal support body including a vertical rod having an upper connector and a lower connector on both upper and lower ends thereof, multiple hooks arranged on the outer side of the upper connector and the lower connector, a bulb mounted base connected to the center of the longitudinal support body;

a fabric cover made of a transparent, flexible, soft fabric, a largest external periphery thereof forming a circular or rectangular enlarged part, along the periphery of the enlarged part, the fabric cover is divided into an upper covering body and a lower covering body respectively having at least two cutting seams from the center of the fabric cover to the enlarged part in order to form at least two pieces of liftable cover surfaces, multiple buckles on the inner side of the cover surfaces provided for buckling up the hooks; and a transverse support body set to be a circular or rectangular frame body according to the shape of the enlarged part, the frame body composed of two symmetrical frame strips having a butt joint structure on both ends for connecting to each other, the transverse support body mounted on the inner margin of the enlarged part to prop up the enlarged part and generate a tension force by hooking up the buckles of the upper and lower cover surfaces and the hooks of the upper and lower connectors so that the transverse support body encircled the longitudinal support body to form a cubical space, and at least a light bulb installed in the bulb mounted base in the center of the fabric cover for keeping a safety distance from the upper and lower covering bodies.

6. The artistic formative lampshade assembly as claimed in claim 5, wherein the vertical rod has a longitudinal through-hole provided for a power cord of the bulb mounted base.

7. The artistic formative lampshade assembly as claimed in claim 5, wherein the transverse support body is a circular frame body composed of two symmetrical semi-circular frame strips, and one end of the butt joint structure is a sleeve and another end thereof is an inserted column for butting and jointing each other.

8. The artistic formative lampshade assembly as claimed in claim 5, wherein the transverse support body is a rectangular frame body composed of two symmetrical U-shaped frame strips, and one end of the butt joint structure is a sleeve and another end thereof is an inserted column for butting and jointing each other.

* * * * *